United States Patent [19]

Ohtsuka et al.

[11] Patent Number: 4,600,291

[45] Date of Patent: Jul. 15, 1986

[54] ELECTRO-PHOTOGRAPHIC DEVICE WITH A PROCESSING HEAD HAVING MULTIPLE CHAMBERS

[75] Inventors: Shuichi Ohtsuka; Akira Yoda; Akinori Kimura; Isoji Takahashi, all of Kanagawa, Japan

[73] Assignee: Fuji Photo Film Co., Ltd., Kanagawa, Japan

[21] Appl. No.: 578,522

[22] Filed: Feb. 9, 1984

[51] Int. Cl.[4] ..... G03G 15/00

[52] U.S. Cl. ..... 355/3 R; 355/10; 355/16

[58] Field of Search ..... 355/3 R, 7, 10, 16, 355/54, 64, 65

[56] References Cited

U.S. PATENT DOCUMENTS

| | | | |
|---|---|---|---|
| 3,528,355 | 9/1970 | Blackert | 355/10 |
| 3,697,173 | 10/1972 | Sasaki et al. | 355/27 |
| 3,964,828 | 6/1976 | Yamada et al. | 355/10 |
| 3,972,610 | 8/1976 | Gross | 355/7 |
| 4,461,561 | 7/1984 | Plumadore | 355/3 R |

*Primary Examiner*—Arthur T. Grimley
*Assistant Examiner*—J. Pendegrass

[57] ABSTRACT

An electrophotographic device having a process head wherein four stages of charging/exposing, developing, drying and fixing are continuously arranged at intervals corresponding to one frame of a film, and a process which requires a longer processing time is conducted simultaneously while other processes are being conducted, thereby completing a whole process in a shorter time by a continuous operation.

9 Claims, 11 Drawing Figures

ELECTRO-PHOTOGRAPHIC DEVICE WITH A PROCESSING HEAD HAVING MULTIPLE CHAMBERS

BACKGROUND OF THE INVENTION (1) Field of the Invention

This invention relates to an electrophotographic device having a processing head which comprises four separate stages charging/exposing, developing, drying, and fixing, and which simultaneously processes a plural number of frames of a recording film.

(2) Description of the Prior Art

Picture image data is generally recorded on a microfilm or the like by a 5-stage processing which comprises charging, exposing, developing, drying and fixing in a wet-type electrophotographic recording system. In short, a film or an electro-photosensitive material is charged on the surface thereof by corona-discharge in a charging process and forwarded to an exposing process. In the exposing process, picture image data to be recorded is projected and recorded on the film via an optical system as an electrostatic latent image. The film with the electrostatic latent image is fed to a developing process, where a developer is applied on the photosensitive surface thereof, and toner is made to electrically adhere according to the pattern of the latent image. Then, the film is passed to the drying process to dry unnecessary or excess developer. The toner which electrically adheres is fused in a fixing process, thereby recording the picture image data on the film, almost permanently. If a special liquid developer is used, it may be dried and fixed simultaneously. In such a case, the drying process includes the fixing process and the film may be finished completely by a four-stage process.

As it is possible to forward the image recording process by a frame of a film in such an electrophotographic system, it can advantageously reproduce picture image data immediately. Also, since the electro-photosensitive member is not photosensitive until it is charged, the film can be inserted under daylight conditions and it is more advantageous compared with conventional recording systems using a silver halide photographic material. Therefore, it has been applied in various fields.

In the above electrophotographic recording system, as the toner electrically adheres to an electro-photosensitive member as described above, it is necessary to immediately fix it. The above processing is, therefore, conducted on each frame consecutively and continuously. There have been proposed various types of recording heads which can conclude image processing in a short time and have processing sections arranged in a space-saving manner.

A conventional head is shown in FIGS. 1(*a*) and 1(*b*). The recording head 10 in FIG. 1(*a*) is provided with a charging/exposing section 11, a fixing section 12 adjacent thereto, a liquid-removing section 13, and a developing section 14, arranged in that order, and all the sections other than the liquid-removing section 13 have openings of a size corresponding to a frame of a film. A frame of the film is uniformly charged and projected with an image at the charging/exposing section 11, then passed to the developing section 14 via the fixing section 12 and the liquid-removing section 13 and processed for development. It then is reversed to be passed in the direction toward the liquid-removing section 13 to remove the liquid and dry while moving toward the fixing section 12. The fixing process is conducted in the section and at the same time a new frame adjacent to the first frame is charged and exposed at the charging/exposing section.

The recording head 20 shown in FIG. 1(*b*) is an example where a main body 21 is slidably provided in the advancing direction of the film and comprises of a developing section 22, an exposing section 23, a charging section 24, and a drying section 25 arranged in due order. In the recording head 20, the main body 21 is moved in the advancing direction of the film toward a frame thereof which is held stationary at a predetermined position to conduct processes from charging to developing consecutively, by the charging section 24, the exposing section 23, and the developing section 22. Then, the main body 21 is reversed in movement so that the drying section 25 comes to face the frame to conduct drying and fixing operations. As reference materials concerning FIG. 1(*a*), there are U.S. Pat. No. 3,972,610 and U.S. Pat. No. 4,082,442, and other. As for FIG. 1(*b*), there is Japanese Patent Publication No. 54-13786.

The conventional processing heads for recording however, have a common defect: a complex feeding mechanism because the relative moving direction of the head must be reversed after developing. Also, it is detrimental in processing as far as efficiency is concerned because plural processes cannot be conducted simultaneously, and the intervals between processes tend to become extended. Further, the processing head for recording shown in FIG. 1(*a*) is detrimental in that since a pressure reducing pump is used for sending the developer into the developing chamber, the structure of the liquid passage system becomes complicated and thus expensive.

SUMMARY OF THE INVENTION

It is an object of this invention to provide a reliable electrophotographic device of low cost for an electrophotographic system comprising four sections for exposure, development, drying and fixing, which sections are arranged at intervals equivalent to that between frames on a film so that while one process which takes a long time is being conducted, other processes may be conducted simultaneously, thereby saving time as a whole.

In order to achieve the above purpose, the present invention is characterized by a structure comprising a charging/exposing chamber, a developing chamber, a drying chamber, and a fixing chamber, arranged in that order along the advancing direction of a electrophotosensitive material and formed integrally, wherein the respective chambers separately open upon each frame of the photosensitive material. The charging/exposing chamber is attached with a discharging mechanism and a lens member; the developing chamber is provided with a feeding mechanism for a developer; the drying chamber is provided with a drying mechanism and the fixing chamber is provided with a fixing mechanism such as a fixing lamp.

DETAILED DESCRIPTION OF THE INVENTION

Figure 1A:
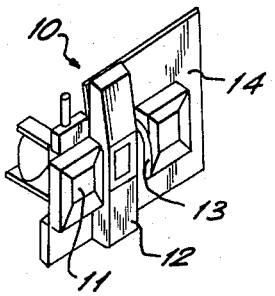
FIG. 1(a) (PRIOR ART)
FIGS. 1(*a*) and 1(*b*) are perspective views showing a conventional processing head for an electrophotographic device.
Figure 2A:
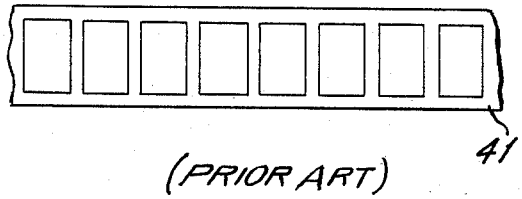
(PRIOR ART) FIG. 2(a)
FIGS. 2(*a*) and 2(*b*) are schematic views showing an electro-photosensitive material or film.
Figure 1B:
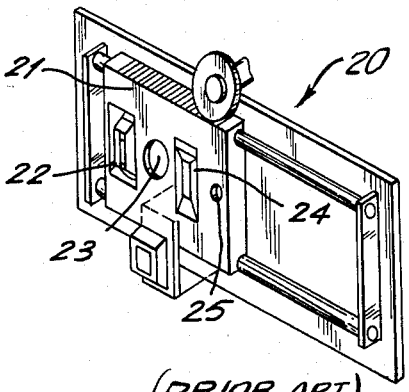
(PRIOR ART) FIG. 1(b)
Figure 2B:
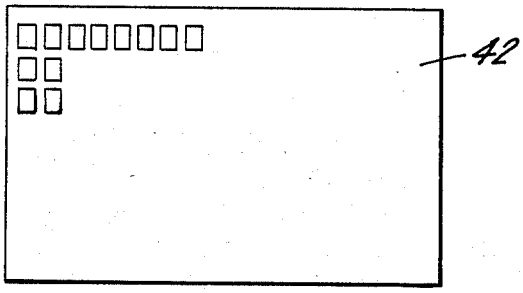
(PRIOR ART) FIG. 2(b)

FIG. 2(*a*) shows an example of an electro-photosensitive member to be used in the present invention. It comprises an elongated film 41 having a plural number of frames with picture images arranged at constant intervals. FIG. 2(*b*) shows a fiche 42 with plural picture images formed on a sheet of a photosensitive member. Other films to be used in this invention may include a well-known electrophotosensitive member having a photoconductive layer on a support member which has been processed for electric conductivity. Blip marks for counting the number of frames may be imaged on these films at the time of forming the picture images, or they may be printed in advance.

Figure 3:
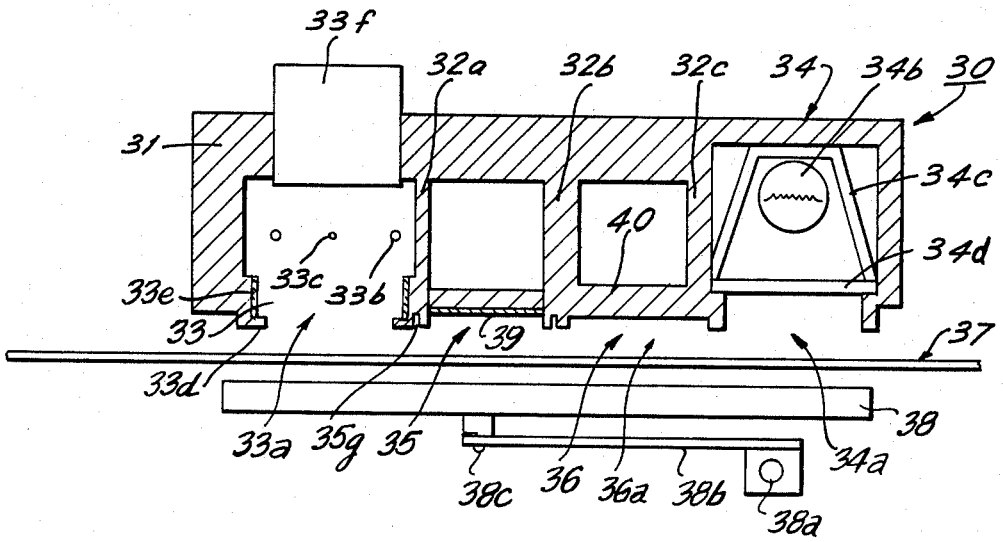
FIG. 3 is a sectional view of a processing head according to the present invention.
Figure 4A:
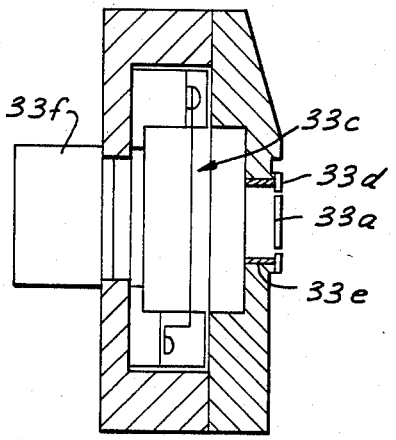
FIGS. 4(*a*), 4(*b*), 4(*c*) and 4(*d*) are sectional views of back sections of the processing head.
Figure 4B:
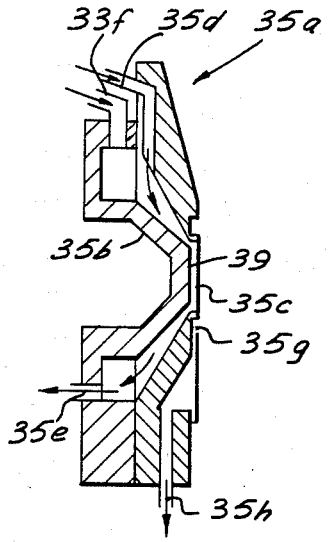
Figure 4C:
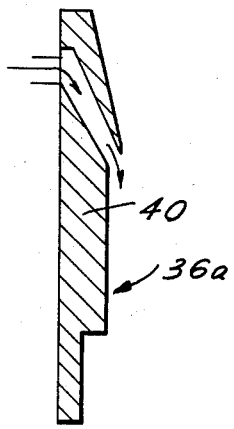
Figure 4D:
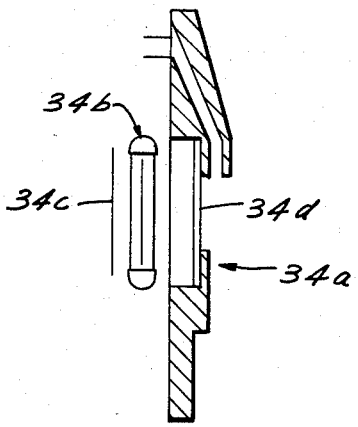

FIG. 3 schematically shows a process head according to this invention. As shown in the figure, a processing head 30 is provided with a housing 31. The housing 31 is internally divided by partitions 32*a*, 32*b*, and 32*c* into a charging/exposing chamber 33, a developing chamber 35, a drying chamber 36 and a fixing chamber 34. The charging/exposing chamber 33, the developing chamber 35, the drying chamber 36 and the fixing chamber 34 face respectively a film 37, are arranged in a line continuously in the advancing direction of the film, and have respective openings corresponding to one frame each of film 37. A press plate 38 is provided to face the housing 31. This press plate is fixed by means of an arm 38*b* attached to a rotatable shaft 38*a* for the press plate. It is desirable that the structure allow the point 38*c* to be movable and that the press plate 38 can come in contact with the surface of the process head 30. The press plate 38 is structured so as to press the film 37 closely against the process head 30 during processing and to release the same when the film is advanced. Corona electrodes 33*b* are provided above an opening 33*a* inside said charging-/exposing chamber 33. The corona electrodes 33*b* are there to generate corona discharge for charging the film surface at the opening 33*a* and a corona wire 33*c* is preferably provided between the corona electrodes 33*b*. A charging mask 33*d* is provided on the outer periphery of the opening 33*a* to restrict the charging area to the size of a frame. A high voltage is applied for corona discharge between wire 33*c* and electrodes 33*b*. Each electrode 33*b* is normally kept at a potential closer to grounding. The charging mask 33*d* should be positioned as close as possible to the film surface and reduced in thickness in order to clearly demarcate the discharge area on the film. If a flexible material is used, it can be positioned closer to the film to achieve a higher efficiency. Reference numeral 33*e* denotes a bias electrode for charging, which improves the uniformity of the charge by applying a potential substantially equivalent to that of the photosensitive member. An exposure lens 33*f* is provided at a position opposite to the opening 33*a* in the charging/exposing chamber 33. Lens 33*f* is provided to focus picture image data of a text provided separately (not shown) through opening 33*a* on film 37 and expose it to light. FIG. 4(*a*) is a section view of the charging/exposing chamber 33. A corona wire 33*c* is provided at the center and a lens 33*f* for exposure and the opening 33*a* are arranged on opposite sides of the corona wire 33*c*.

Next to the charging/exposing chamber 33 (FIG. 3) there is provided a developing chamber 35. A feeding mechanism for a liquid developer is provided inside the developing chamber 35 and an electrode 39 for developing on the side which faces film 37.

FIG. 4(*b*) shows a schematic cross sectional view of the developing chamber 35. A cover 35*a* is provided inside the developing chamber 35, and an internal member 35*b* is positioned inside cover 35*a*, thereby defining a supply route 35*d* and a discharge route 35*e* which run through the opening 35*c*. A liquid developer flows in from outside through the supply route 35*d* to the opening section 35*c* to contact the film surface and the toner electrically adheres to the static latent image formed in the charging/exposing section 33. The developer after development is led to outside through the discharge route 35*e*. The film is pressed onto the opening section 35*c* by press plate 38 to prevent leakage of the developer.

It is preferable to provide a squeeze means to remove developer after the developing process and to improve the efficiency of the drying process subsequent thereto. There are many useful mechanisms such as (a) a corona squeeze, (b) an absorption mechanism, (c) a mechanism to suck liquid drops from the film surface with a piece of felt or capillary, (d) a mechanism for applying air or (e) a mechanism to supply hot air. Reference numeral 35*f* denotes an inlet for the air, which is to be blown in. Further, a suction slit 35*g* is provided to prevent damaging the image which might otherwise be caused as the developer leaks from the developing chamber 35 to seep into the adjacent processing chamber or onto other images on the film during developing or squeezing of the developer. The suction slit 35*g* is under reduced pressure as it is connected to a suction pump (not shown) via a suction pipe 35*h*. It is not necessary to provide the suction slit 35*g* over the entire periphery of the opening of the developing chamber as long as it is provided on at least one side thereof, for example at the bottom or the side.

Next to the developing chamber 35 is provided a drying chamber 36 which is demarcated by a partition wall 40 opposite the film surface. In order to improve drying efficiency, the opening 36*a* of the drying chamber 36 is made in size larger than the opening 35*c* of the developing chamber 35, and the size of the opening 36*a* is made larger than the width of the film. The drying chamber 36 is provided with a drying means to supply air or hot air to dry the remaining developer, or with any other known drying means. A squeezing means similar to the one mentioned hereinabove may be provided in the chamber. FIG. 4(*c*) shows a sectional view of the drying chamber, in which the drying air is applied to the film 37 in accordance with the arrow in the drawing. To shorten the drying time, it is most efficient to increase the air speed, and this can be achieved by narrowing the distance between the partition 40 and the film 37. More specifically, an air speed of 1 m/sec or more is desirable. With an air supply means of lower capacity, the partition 40 is preferably spaced from the film 37 2 mm or less in order to achieve the above air speed.

A fixing lamp 34*b* is provided inside the fixing section on chamber 34 positioned on the side of the housing 31 to extend toward the opening section 34*a* and a reflection mirror 34*c* is provided behind the fixing lamp 34*b*. The fixing lamp 34*b* may be a xenon lamp, a halogen lamp, or another lamp.

If a light transmissive member 34*d* such as plastic film or glass is provided between the fixing lamp 34*b* and the film 37, an adverse effect which might be generated by a gassified substance at the time of fixing, may be prevented. It is effective in prevention if air is circulated between the film 37 and the light transmissive member 34*d*. It is further preferable to widen the distance between the film 37 and the light transmissive member 34*d* because the light transmissive member can be protected from being soiled by scattering toner. More specifically, the distance is more than 1 mm, and preferably 3 mm or more. The sectional view of the fixing chamber 34 is shown in FIG. 4(*d*). The light transmissive member 34*d*, the fixing lamp 34*b*, and the reflection mirror 34*c* are arranged in this order starting from the opening 34*a*.

Although three partitions 32*a*, 32*b* and 32*c* are provided, the number of partitions is variable depending on the mechanical strength, method of manufacture, etc. of the processing head 30.

The feeding mechanism for photosensitive material or film 37 which feeds the material or film frame by frame may be a motor such as a pulse motor, which is provided with a mechanism for feeding a predetermined length of material, or a mechanism which positions a film by optically detecting marks which are provided on film 37 at predetermined intervals.

Figure 5:
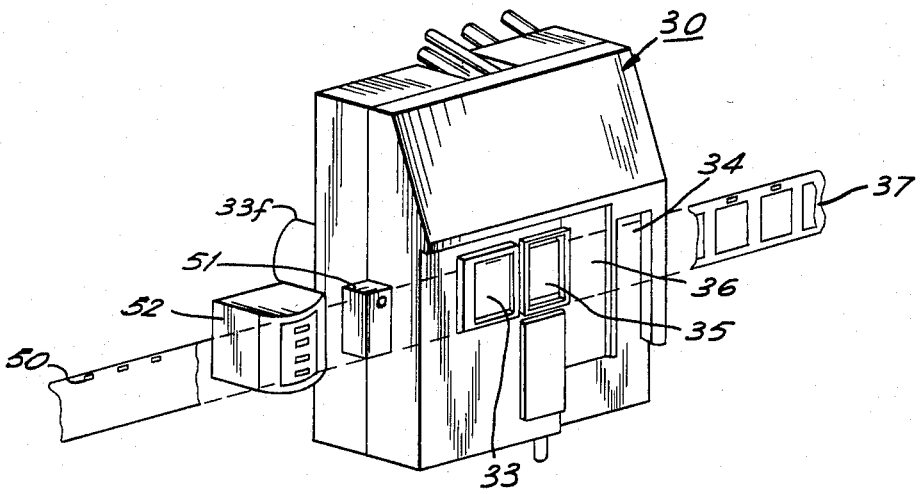
FIG. 5 shows an embodiment of an electrophotographic device using the processing head according to the present invention.

FIG. 5 shows one embodiment of an electrophotographic recording/reproduction system which utilizes the processing head 30 of the present invention. A roll of film 37 of 16 mm width is printed in advance with blip marks 50 for every frame pitch. The blip marks 50 are read by a blip mark sensor 51 for controlling the feed of the film 37 or for counting the number of frames. It is more convenient if the film 37 is previously mounted in a cassette which is in turn inserted in an electrophotographic device having the processing head of the present invention so that the film can be used for recording/reproducing desired video data. In the embodiment shown in FIG. 5, the roll of film 37 contained in a cassette is provided with a magnetic tape at its start. As the cassette is inserted in the main body of the device, the retrieval data of the picture image recorded on the magnetic tape or the process data proper on the roll of film 37 can be read out by a magnetic head 52 provided on the main body of the device.

In order to form a picture image on the roll of film 37, the blip mark 50 of the film is counted by means of the blip mark sensor 51 and the frame to be photographed is forwarded to the charging/exposing chamber 33 by means of a film driving mechanism (not shown) provided on the main body of the device. As the film is forwarded one frame by one frame through the charging/exposing chamber 33, developing chamber 35, drying chamber 36 and fixing chamber 34 arranged in this order, it goes through various processes and the picture images are formed thereon. The film with picture images can be projected onto a screen by a separate device exclusively for reading. The picture image can also be focused on a screen (not shown) to be used as a reader by projecting a light onto the film 37 from behind the press plate 38 as shown in FIG. 3 and by means of the exposure lens 33*f*.

Figure 6:
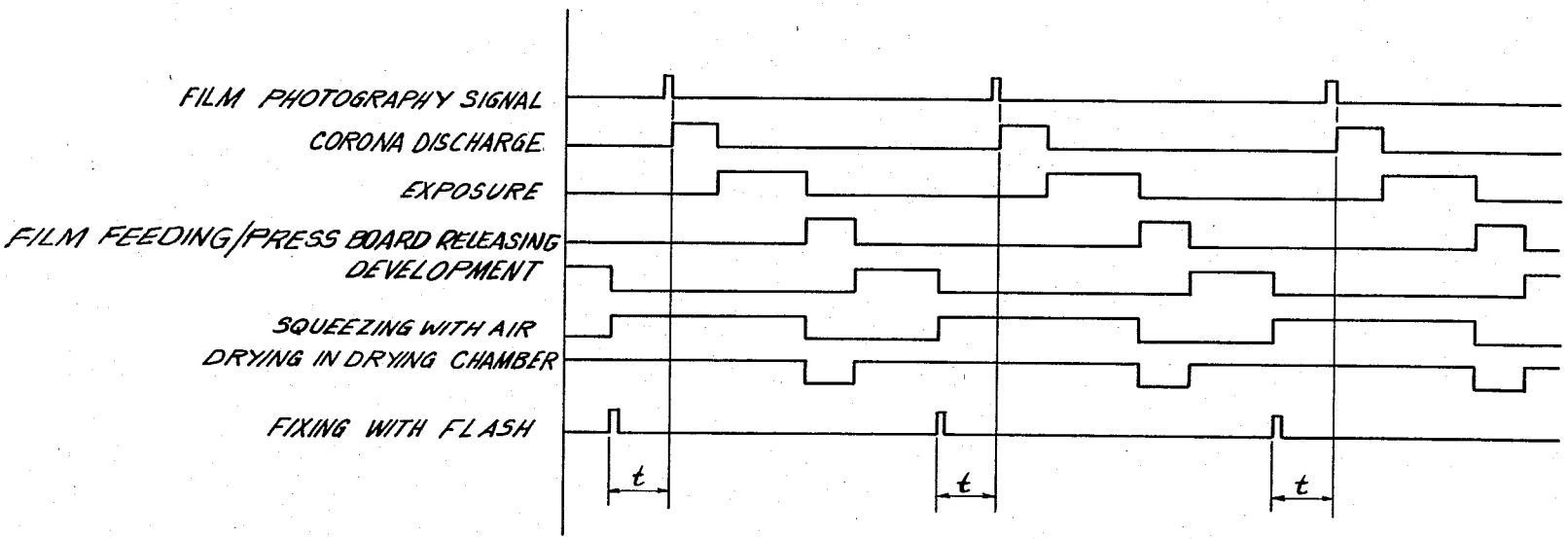
FIG. 6 is a chart showing the sequence of processing.

FIG. 6 shows an example of the sequence of events in a case where a large number of frames are continuously photographed, and the operations will be described hereinunder.

When the first frame of the film 37 is suspended in front of opening 33*a* of the charging/exposing chamber 37, the film 33 is pressed closely to, and positioned at, the opening 33*a* by the press plate 38. With a start signal, a corona discharge is started to charge electricity uniformly over the portion where a picture image is to be formed, and then picture image data is focused via an exposing lens 33*f*. When the press plate 38 is released, the film is forwarded by one frame and when the first frame come to be positioned at the opening of the developing chamber, it is pressed closely to the opening with the press plate 38 again. A developer is supplied by a feeding pump (not shown) or a suction pump (not shown) in a predetermined quantity of develop the electrostatic latent image and then excessive liquid is squeezed out by air. Although it is sufficient to actuate the suction slit 35*g* for suction only while excessive liquid is dried by air, it may be actuated throughout the entire stages of the processing. The first frame is then moved to the opening of the drying chamber and is closely pressed to it by press plate 38. The frame is dried with a drying means which is provided at the drying chamber. After drying, the film 37 is moved again by one frame to be positioned at the opening of the fixing chamber. The image is fixed by flashing of a xenon lamp, for instance, to complete the processing.

The above explanation has been given with respect to the first frame of the film, but a similar operation applies to the second frame, and to the others thereafter. If continuous operation is desired, while the first frame is being dried, the second frame is subjected to the liquid-removing process, and the third frame is exposed simultaneously, to save time.

As described hereinabove, the processes for exposing, liquid-removing, and drying take a longer time compared to the other processes. This invention arranges the four stages in a recording head consecutively in a line, so that while one frame is being dried, other adjacent frames can be simultaneously processed, thereby remarkably reducing the overall processing time and shortening timewise the intervals between exposures, for continuous shooting.

Access of light from outside should be prevented, except for the light projected for focusing the image, throughout the process from charging to completion of the development as it causes deterioration of the picture quality, such as fogging. Therefore, the fixing operation with a flash for a frame which is positioned at the fixing chamber should be conducted after the developing operation for another frame which is positioned at the developing chamber has been completed, and before the charging operation for another frame which is positioned at the charging/exposing chamber is started (the duration of t in FIG. 5) to prevent deterioration which might otherwise be caused by the light leakage of the fixing lamp and to effectively reproduce a picture image of high quality. This invention makes it possible to finish such flashing fixation within the time t mentioned above, while offering a clear image.

As has been described above, the construction of a processing head for an electrophotographic device according to the present invention offers many advantages in practical use, such as:

1. The charging/exposing, developing, drying and fixing chambers can be constructed as an integral part, resulting in a compact and inexpensive device.

2. Simultaneous and continuous processing is possible, as respective chambers are arranged at intervals corresponding to one frame of the a film, and thus the required time can be greatly reduced in continuous recording.
3. As the drying chamber is located between the developing and the fixing chambers, the fixing chamber can be protected from dirt caused by leaking developer from the developing chamber, thereby improving the reliability of the fixing process.
4. Provision of a light transmissive member in the fixing chamber prevents the fixing lamp from adverse effect caused by the vaporized substances generated at the time of fixing.
5. A separate drying chamber makes it possible to narrow the distance between the partition 40 and the electro-photosensitive material. Drying can be carried out efficiently with the use of an inexpensive air supply means.
6. By limiting the time for fixing with a flash, adverse effects such as optical deterioration of adjacent frames due to leakage of light from the fixing lamp, can be prevented.
7. As it is not necessary to use a pressure reducing means such as a vacuum pump to supply the developer, the device can be made inexpensively.
8. The device as a whole can be constructed at lower cost by combining adequate and inexpensive components suitable for respective processing.
9. As the drying chamber is made of a size larger than the developing chamber, the remaining developer on the film is dried with certainty.

What is claimed is:

1. An electro-photographic device having a processing head for forming picture images on an electro-photosensitive material, said processing head comprising, as an integral unit, a housing having four processing chambers including a charging chamber which also serves as an exposing chamber, a developing chamber, a drying chamber and a fixing chamber, each of said processing chambers having an opening abutting a plane in which electro-photosensitive material passes said processing head, said openings being arranged in the following order: charging chamber opening, developing chamber opening, drying chamber opening, and fixing chamber opening in the direction of movement of the electro-photosensitive material, the openings being spaced apart at intervals corresponding to the length of a frame of a picture image formed on the electro-photosensitive material; said charging chamber having charging means for charging a prescribed area of the electro-photosensitive material abutting said charging chamber opening, said charging chamber opening being positioned in an optical path of a picture image light for exposing the electro-photosensitive material, said path passing through said charging chamber, so that electro-photosensitive material abutting on said charging chamber is exposed to said picture image light to form a static latent image on a surface layer of the exposed electro-photosensitive material; said developing chamber being constructed such that an interval is formed as its opening abuts against the surface layer with the static latent image, for developing the static latent image by supplying a developer into said interval; said developing chamber having an outer periphery with a suction slit facing the electro-photosensitive material, for removing leaking developer by negative pressure; said drying chamber being constructed such that drying air is applied to the electrophotosensitive material to dry the developer; and said fixing chamber comprising a fixing means for fixing a toner picture image formed on the electro-photosensitive material.

2. An electro-photographic device having a processing head for forming picture images on an electro-photosensitive material, said processing head comprising, as an integral unit, a housing having four processing chambers including a charging chamber which also serves as an exposing chamber, a developing chamber, a drying chamber and a fixing chamber, each of said processing chambers having an opening abutting a plane in which electro-photosensitive material passes said processing head, said openings being arranged in the following order: charging chamber opening, developing chamber opening, drying chamber opening, and fixing chamber opening in the direction of movement of the electro-photosensitive material, the openings being spaced apart at intervals corresponding to the length of a frame of a picture image formed on the electro-photosensitive material; said charging chamber having charging means for charging a prescribed area of the electro-photosensitive material abutting said charging chamber opening, said charging chamber opening being positioned in an optical path of a picture image light for exposing the electro-photosensitive material, said path passing through said charging chamber, so that electro-photosensitive material abutting on said charging chamber is exposed to said picture image light to form a static latent image on a surface layer of the exposed electro-photosensitive material; said developing chamber being constructed such that an interval is formed as its opening abuts against the surface layer with the static latent image, for developing the static latent image by supplying a developer into said interval; said drying chamber being constructed such that drying air is applied to the electro-photosensitive material to dry the developer; said drying chamber having a partition, and the distance between the partition and the electro-photosensitive material being less than 2 mm; and said fixing chamber comprising a fixing means for fixing a toner picture image formed on the electro-photosensitive material.

3. An electro-photographic device having a processing head for forming picture images on an electro-photosensitive material, said processing head comprising, as an integral unit, a housing having four processing chambers including a charging chamber which also serves as an exposing chamber, a developing chamber, a drying chamber and a fixing chamber, each of said processing chambers having an opening abutting a plane in which electro-photosensitive material passes said processing head, said openings being arranged in the following order: charging chamber opening, developing chamber opening, drying chamber opening, and fixing chamber opening in the direction of movement of the electro-photosensitive material, the openings being spaced apart at intervals corresponding to the length of a frame of a picture image formed on the electro-photosensitive material; said opening of said drying chamber being larger than said opening of said developing chamber; said charging chamber having charging means for charging a prescribed area of the electro-photosensitive material abutting said charging chamber opening, said charging chamber opening being positioned in an optical path of a picture image light for exposing the electro-photosensitive material, said path passing through said charging chamber, so that electro-photosensitive material abutting on said charging chamber is exposed to said picture image light to form a static latent image on a surface layer of the exposed electro-photosensitive material; said developing chamber being constructed such that an interval is formed as its opening abuts against the surface layer with the static latent image, for developing the static latent image by supplying a developer into said interval; said drying chamber being constructed such that drying air is applied to the electro-photosensitive material to dry the developer; and said fixing chamber comprising a fixing means for fixing a toner picture image formed on the electro-photosensitive material.

4. An electro-photographic device as claimed in claim 3, wherein the electro-photosensitive material has a predetermined width, and wherein the opening of said drying chamber has a width larger than the electro-photosensitive material.

5. An electro-photographic device as claimed in claim 3, comprising pressing means for forcing the electro-photosensitive material against said processing head at least at one of said charging and developing chambers.

6. An electro-photographic device as claimed in claim 5, wherein said pressing means comprises a press plate for engagement against the electro-photosensitive material, a stationary point at said plate, an arm connected to said stationary point, and a rotatable shaft rotatably supporting said arm.

7. An electro-photographic device having a processing head for forming picture images on an electro-photosensitive material, said processing head comprising, as an integral unit, a housing having four processing chambers including a charging chamber which also serves as an exposing chamber, a developing chamber, a drying chamber and a fixing chamber, each of said processing chambers having an opening abutting a plane in which electro-photosensitive material passes said processing head, said openings being arranged in the following order: charging chamber opening, developing chamber opening, drying chamber opening, and fixing chamber opening in the direction of movement of the electro-photosensitive material, the openings being spaced apart at intervals corresponding to the length of a frame of a picture image formed on the electro-photosensitive material; said charging chamber having charging means for charging a prescribed area of the electro-photosensitive material abutting said charging chamber opening, said charging chamber opening being positioned in an optical path of a picture image light for exposing the electro-photosensitive material, said path passing through said charging chamber, so that electro-photosensitive material abutting on said charging chamber is exposed to said picture image light to form a static latent image on a surface layer of the exposed electro-photosensitive material; said developing chamber being constructed such that an interval is formed as its opening abuts against the surface layer with the static latent image, for developing the static latent image by supplying a developer into said interval; said drying chamber being constructed such that drying air is applied to the electro-photosensitive material to dry the developer; and said fixing chamber comprising a fixing means for fixing a toner picture image formed on the electro-photosensitive material; said fixing means comprising a fixing lamp, a reflective mirror for reflecting light from said lamp, and a light transmissive member for shielding vaporized substances of toner formed during fixing.

8. An electro-photographic device as claimed in claim 7, wherein the distance between said light transmissive member and the electro-photosensitive material is greater than 1 mm.

9. An electro-photographic device as claimed in claim 7, wherein said distance permits passage of air between said light transmissive member and the electro-photosensitive material.

* * * * *